US007698914B2

(12) United States Patent
Ma

(10) Patent No.: US 7,698,914 B2
(45) Date of Patent: Apr. 20, 2010

(54) PADLOCK

(76) Inventor: Sam Ma, No. 299, Sec. 1, Gongyuan Rd., Changhua City, Changhua County 500 (TW)

( * ) Notice: Subject to any disclaimer, the term of this patent is extended or adjusted under 35 U.S.C. 154(b) by 0 days.

(21) Appl. No.: 12/051,612

(22) Filed: Mar. 19, 2008

(65) Prior Publication Data

US 2009/0113949 A1 May 7, 2009

(51) Int. Cl.
*E05B 37/06* (2006.01)

(52) U.S. Cl. ..... 70/28; 70/22; 70/312

(58) Field of Classification Search ..... 70/22, 70/27, 28, 311, 312, 304–306
See application file for complete search history.

(56) References Cited

U.S. PATENT DOCUMENTS

| | | | | | |
|---|---|---|---|---|---|
| 839,795 | A * | 12/1906 | Wilcox | 70/28 |
| 877,682 | A * | 1/1908 | Turman | 70/28 |
| 1,903,885 | A * | 4/1933 | Trewhella | 70/27 |
| 3,983,724 | A * | 10/1976 | Foote | 70/25 |
| 4,860,561 | A * | 8/1989 | Hwang | 70/28 |
| 5,042,277 | A * | 8/1991 | Jenn-Rong | 70/28 |
| 5,524,462 | A * | 6/1996 | Loughlin | 70/20 |
| 5,609,048 | A * | 3/1997 | Ling | 70/28 |
| 5,685,179 | A * | 11/1997 | Yang | 70/28 |
| 5,765,409 | A * | 6/1998 | Yang | 70/28 |
| 5,782,113 | A * | 7/1998 | Chen | 70/28 |
| 5,901,587 | A * | 5/1999 | Chen | 70/28 |
| 5,918,489 | A * | 7/1999 | Yang | 70/28 |
| 5,953,940 | A * | 9/1999 | Ling | 70/25 |
| 5,970,755 | A * | 10/1999 | Appelbaum | 70/28 |
| 6,029,481 | A * | 2/2000 | Lai | 70/25 |
| 6,058,744 | A * | 5/2000 | Ling | 70/28 |
| 6,363,758 | B1 * | 4/2002 | Ling | 70/30 |
| 6,381,997 | B1 * | 5/2002 | Chen | 70/28 |
| 6,470,718 | B1 * | 10/2002 | Yang | 70/30 |
| 7,216,517 | B2 * | 5/2007 | Ling et al. | 70/21 |

* cited by examiner

*Primary Examiner*—Suzanne D Barrett
(74) *Attorney, Agent, or Firm*—Browdy and Neimark, PLLC

(57) ABSTRACT

A padlock includes a base, a combination controlled lock unit having a shaft passing through a top hole of the base into an accommodation chamber of the base, three combination wheels rotatably sleeved onto the shaft, and three retaining wheels sleeved onto the shaft and respectively engaged with the combination wheels, a driving member connected with the shaft, two shackles having bottom ends respectively connected to the base and top ends detachably engaged with each other, and a latch connected with the shaft so as to be driven to move between a locking position where a block portion of the latch stops at least pivotable one of the shackles from movement for ensuring engagement of the top ends of the shackles and a unlocking position where the block portion moves away from the pivotable shackle for allowing disengagement of the top ends of the shackles.

9 Claims, 3 Drawing Sheets

PADLOCK

BACKGROUND OF THE INVENTION

1. Field of the Invention

The present invention relates generally to locks, and more specifically to a padlock that has a security function and a unique figuration.

2. Description of the Related Art

Conventional locks generally include two types, i.e. a key controlled type, which needs a correct key to unlock it, and a combination controlled type, which needs a correct permutation of numbers or symbols to unlock it.

Usually, the conventional key or combination locks have ordinary or monotonic configurations, and no matter how many designs the manufactures do the overall configurations of the conventional key or combination locks always show an incongruous appearance because of the existence of a shackle of the lock.

SUMMARY OF THE INVENTION

The present invention has been accomplished in view of the above-noted circumstances. It is one objective of the present invention to provide a padlock, which has a security function and a unique figuration.

It is another objective of the present invention to provide a padlock, which is simple to operate.

To achieve these objectives of the present invention, the padlock comprises a base, a combination controlled lock unit, a shaft, a driving member, and a latch. The base has an accommodation chamber and a top hole in communication with the accommodation chamber. The combination controlled lock unit has a shaft, which is axially moveably disposed in the accommodation chamber of the base with a top end thereof extending out of the base through the top hole of the base, a plurality of combination wheels rotatably sleeved onto the shaft and received in the accommodation chamber for controlling an axial movement of the shaft, and a plurality of retaining wheels sleeved onto the shaft and respectively engaged with the combination wheels. The driving member is connected with the top end of the shaft of the combination controlled lock unit. The shackles have bottom ends thereof respectively connected with two opposite sides of the base and top ends thereof detachably engaged with each other. At least one of the shackles is pivotable relative to the base. The latch has at least one block portion and is movably mounted in the accommodation chamber of the base and connected with the shaft of the combination controlled lock unit so as to be driven by the shaft to move between a locking position where the block portion stops the pivotable shackle from movement for ensuring the engagement of the top ends of the shackles and a unlocking position where the block portion moves away from the pivotable shackle for allowing disengagement of the top ends of the shackles.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
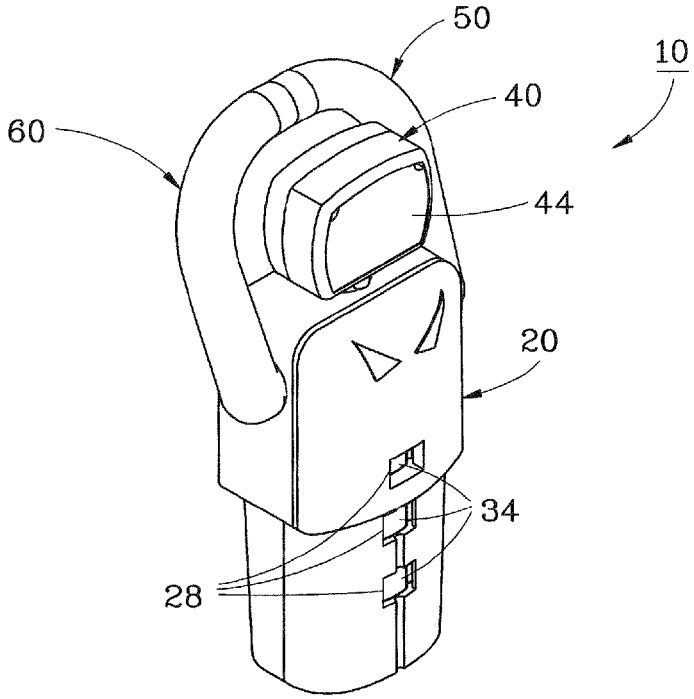
FIG. 1 is a perspective view of a padlock according to a preferred embodiment of the present invention.
Figure 2:
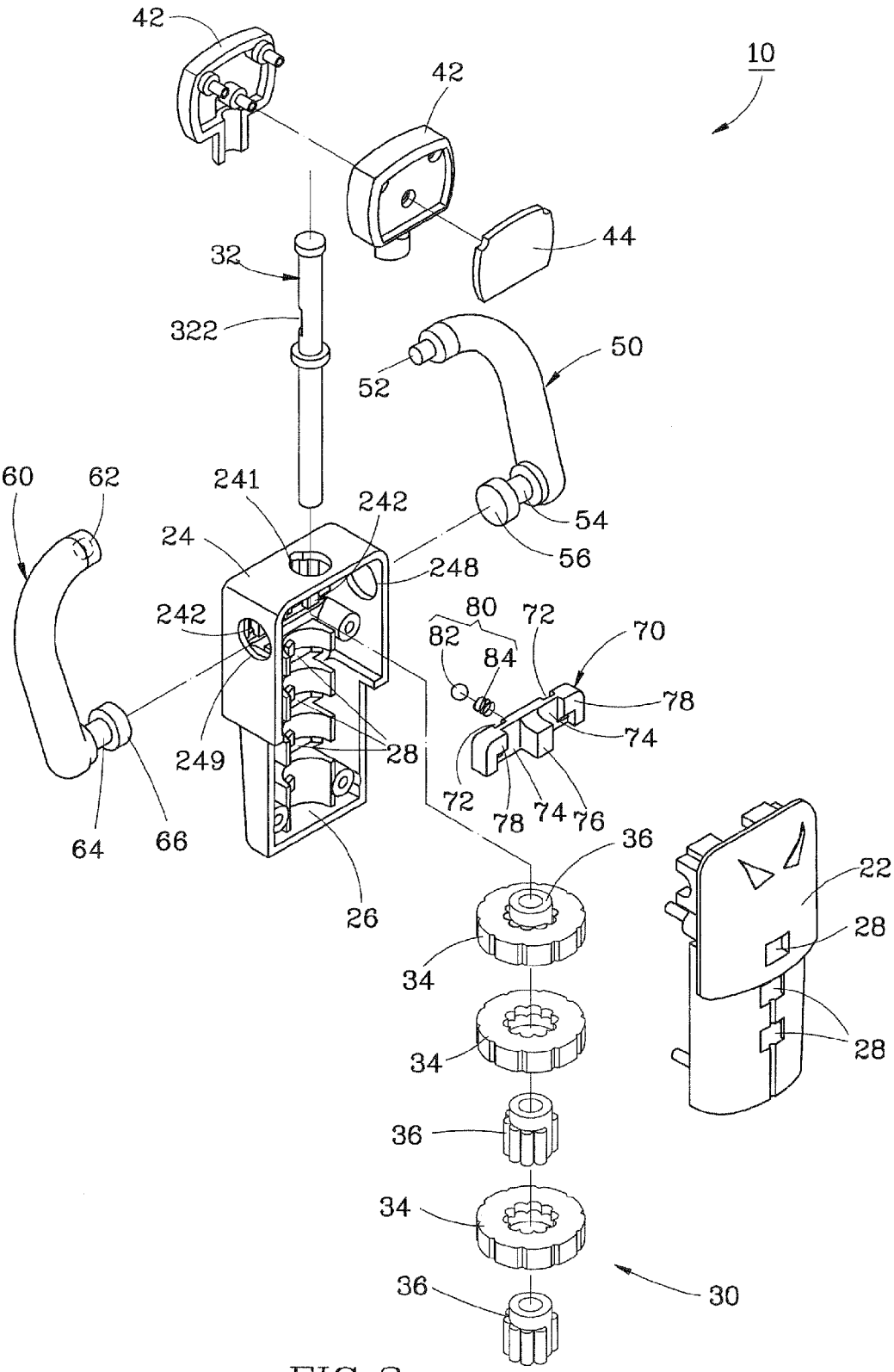
FIG. 2 is an exploded view of the padlock according to the preferred embodiment of the present invention.

Referring to FIGS. 1 and 2, a padlock 10 in accordance with a preferred embodiment of the present invention comprises a base 20, a combination controlled lock unit 30, a driving member 40, a right shackle 50, a left shackle 60, a latch 70, and a positioning member 80.

Figure 4:
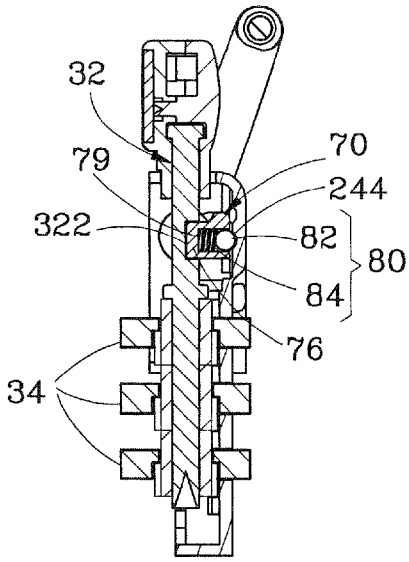
FIG. 4 is a sectional view taken along line 4-4 of FIG. 3.
Figure 6:
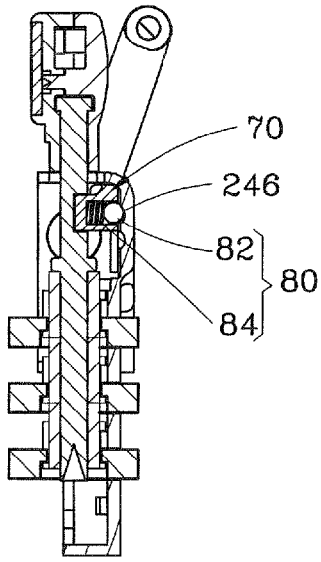
FIG. 6 is a sectional view taken along line 6-6 of FIG. 5.

The base 20 includes a front shell 22 and a rear shell 24 having a top hole 241 on a top side thereof, two spaced guides 242 inside, a first concavity 244 located between the guides 242, a second concavity 246 located above the first concavity 244, as shown in FIGS. 4 and 6, a right pivoting hole 248 on a right side thereof, and a left pivoting hole 249 on a left side thereof. The front shell 22 and the rear shell 24 are coupled to each other so as to define an accommodation chamber 26 therebetween and respectively have three openings 28 in communication with the accommodation chamber 26.

The combination controlled lock unit 30 has a shaft 32 passing through the top hole 241 of the base 20 into the accommodation chamber 26 and provided with a top end extending out of the base 20, and a recess 322, three combination wheels 34 sleeved onto the shaft 32 so as to be located in the accommodation chamber 26 of the base 20 and respectively and partially extending out of the openings 28 of the rear shell 24 for user's operation, and three retaining wheels 36 sleeved onto the shaft 32 and respectively engaged with the combination wheels 34. When the combination wheels 34 are rotated to show a correct permutation, the shaft 32 can be moved in an axial direction of the combination wheels 34. On the contrary, when the combination wheels 34 show a wrong permutation, the shaft 32 cannot be moved axially due to the restriction of the retaining wheels 36.

The driving member 40 is formed of two side plates 42 coupled to each other and fixed on the top end of the shaft 32 of combination controlled lock unit 30 for driving the shaft 32 to move axially. A front side of the one of the side plates 42 is mounted with a decorative plate 44 to be served as a face of the padlock 10.

The right shackle 50 has a top end thereof provided with a protrusion 52 and a bottom end thereof provided with a right pivot 54 pivotally mounted in the right pivoting hole 248 of the rear shell 24 of the base 20 and a pivot portion 56 integrally connected with the right pivot 54.

The left shackle 60 has a top end thereof provided with a hole 62 for insertion of the protrusion 52 of the right shackle 50 and a bottom end thereof provided with a left pivot 64 pivotally mounted in the left pivoting hole 249 of the rear shell 24 of the base 20 and a left pivot portion 66 integrally connected with the left pivot 64.

Figure 3:
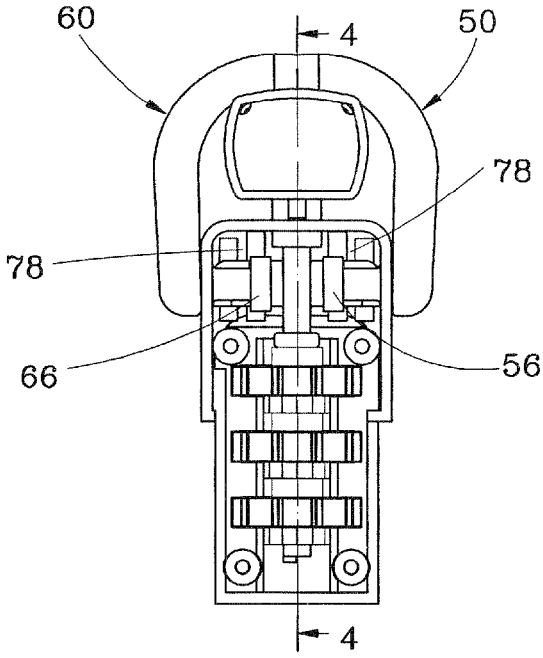
FIG. 3 is a partial sectional view of the padlock according to the preferred embodiment of the present invention, showing that the latch is located at the locking position.

The latch 70 has two guide slots 72 on a rear side thereof for insertion of the guides 242 of the rear shell 24 so as to be movable relative to the base 20 along the guides 242, two notches 74 on a front side thereof for accommodation of the right pivot portion 56 of the right shackle 50 and the left pivot portion 66 of the left shackle 60, a projection 76 located between the notches 74 and engaged with the recess 322 of the shaft 32, as shown in FIG. 4, for enabling the latch 70 to be driven by the shaft 32 to move between a locking position and a unlocking position, and two block portions 78 respectively protruded from peripheries of the notches 74 toward the projection 76. When the latch 70 is located at the locking position, as shown in FIGS. 3 and 4, the right pivot portion 56 of the right shackle 50 and the left pivot portion 66 of the left shackle 60 are respectively stopped by the block portions 78 of the latch 70 and can not move transversely relative to the base 20 such that the protrusion 52 of the right shackle 52 and the hole 62 of the left shackle 60 are firmly engaged with each other, resulting in that the right shackle 50 and the left shackle 60 cannot be pivoted relative to the base 20. When the latch 70 is located at the unlocking position, as shown in FIGS. 5 and 6, the right pivot portion 56 of the right shackle 50 and the left pivot portion 66 of the left shackle 60 and the block portions 78 of the latch 70 are staggered such that the right shackle 50 and the left shackle 60 can be pulled transversely and outwardly by an external force to enable the protrusion 52 of the right shackle 50 and the hole 62 of the left shackle 60 to be disengaged from each other, resulting in that the right shackle 50 and the left shackle 60 can be pivoted relative to the base 20.

The positioning member 80 is received in a positioning hole 79 of the latch 70, as shown in FIG. 4, including an urging member 82 illustrated by a steel ball and an elastic member 84 with two ends respectively stopped against the urging member 82 and the latch 70 such that the urging member 82 can be positioned in the first concavity 244 or the second concavity 246 by means of the movement of the latch 70 for positioning the latch 70 in the locking position or the unlocking position.

Figure 7:
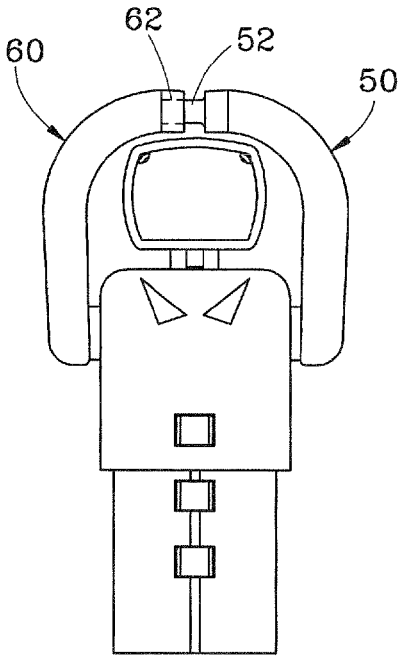
FIG. 7 is a front view of the padlock according to the preferred embodiment of the present invention, showing that the protrusion of the right shackle and the hole of the left shackle are disengaged from each other.
Figure 8:
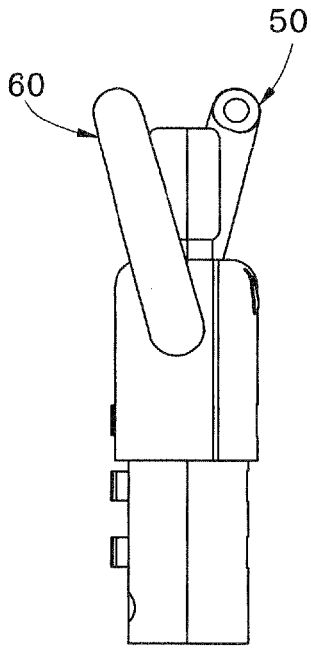
FIG. 8 is a lateral view of the padlock according to the preferred embodiment of the present invention, showing that the left shackle and the right shackle are pivoted relative to the base.
Figure 5:
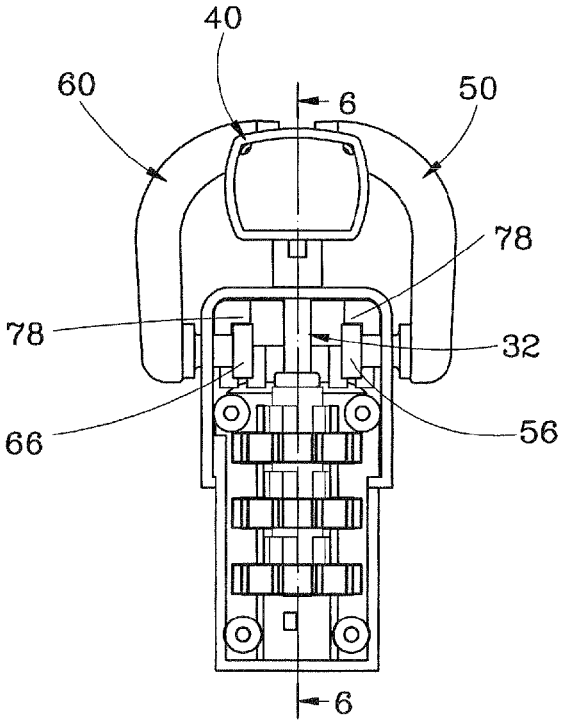
FIG. 5 is similar to FIG. 3 but showing that the latch is located at the unlocking position.

When a user would like to operate the padlock 10 to lock on an object, he/she can rotate the combination wheels 34 of the combination controlled lock unit 30 to show a correct permutation, and then pulls the driving member 40 upwards, as shown in FIGS. 5 and 6, such that the shaft 32 of the combination controlled lock unit 30 can be driven by the driving member 40 to move upwards, resulting in that the latch 70 is moved along with the shaft 32 by means of the engagement of the projection 76 and the recess 322 and located at the unlocking position through the urging member 82. At this time, the block portions 78 of the latch 70 and the right and left pivot portions 56 and 66 of the right and left shackles 50 and 60 are staggered, and therefore the user can respectively pull the right and left shackles 50 and 60 rightwards and leftwards to disengage the protrusion 52 of the right shackle 50 and the hole 62 of the left shackle 60 from each other, as shown in FIG. 7. As a result, the user can rotate the left shackle 60 and the right shackle 50 to make them staggered, as shown in FIG. 8, and then take the left shackle 60 or the right shackle 50 to pass through the to-be-locked object, and then rotates the left shackle 60 and the right shackle 50 to make the protrusion 52 of the right shackle 50 aim at the hole 62 of the left shackle 60, and then pushes the left shackle 60 and the right shackle 50 toward each other to enable the protrusion 52 of the right shackle 50 to be inserted into the hole 62 of the left shackle 60, and then presses the driving member 40 downwards such that the shaft 32 and the latch 70 are moved downwards simultaneously, causing the latch 70 to be located at the locking position, as shown in FIGS. 3 and 4. In this situation, the user can rotate the combination wheels 34 of the combination controlled lock unit 30 to show a wrong permutation such that the shaft 32 cannot be moved axially and the left and right pivot portions 66 and 56 of the left and right shackles 60 and 50 are stopped by the block portions 78 of the latch 70. Therefore, the left and right shackles 60 and 50 cannot be moved transversely and outwardly even if a pulling force exerts respectively on the left and right shackles 60 and 50, resulting in that the padlock 10 is locked.

By means of the aforesaid design, as long as the user pulls the driving member and rotates the left and right shackles, the padlock can be locked on a door, a cupboard, a bag or luggage for providing a simple operation and extensive purposes. Besides, the overall configuration of the padlock can be simulated as a robot, for example, the base is a body of the robot and the driving member is a head of the robot and the left and right shackles are left and right arms of the robot. Therefore, the padlock can provide a special presentation when it is locked on any object. Further, the user can paint a picture or paste up some adornments on the base, the driving member or the left and right shackles according to personal preferences for creating a diverse and lively appearance.

Furthermore, the padlock of the invention can be made with various kinds of design. For example, both of the left shackle and the right shackle are not limited to be pivoted to the base as long as either the left shackle or the right shackle is pivoted to the base. In addition, the number of the block portion of the latch is not limited as long as the block portion of the latch can stop the pivotable shackle from movement. Under this circumstance, when the latch is located at the unlocking position and the user pulls the pivotable shackle and rotates it, the protrusion of the right shackle and the hole of the left shackle can also be disengaged from each other to unlock the padlock.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A padlock comprising:

a base having an accommodation chamber and a top hole in communication with the accommodation chamber;

a combination controlled lock unit having a shaft, which is axially moveably disposed in the accommodation chamber of the base with a top end thereof extending out of the base through the top hole of the base, a plurality of combination wheels rotatably sleeved onto the shaft and received in the accommodation chamber for controlling an axial movement of the shaft, and a plurality of retaining wheels sleeved onto the shaft and respectively engaged with the combination wheels;

a driving member connected with the top end of the shaft of the combination controlled lock unit;

two shackles having bottom ends thereof respectively connected with two opposite sides of the base and top ends thereof detachably engaged with each other, the bottom end of at least one of the shackles being pivotally inserted into a pivoting hole of the base such that the at least one of the shackles is pivotable backwards and forwards relative to the base; and a latch having at least one block portion and movably mounted in the accommodation chamber of the base and connected with the shaft of the combination controlled lock unit so as to be driven by the shaft to move between a locking position where the block portion stops the pivotable shackle from movement for ensuring the engagement of the top ends of the shackles and a unlocking position where the block portion moves away from the pivotable shackle for allowing the top ends of the shackles to be disengaged from each other.

2. The padlock as claimed in claim 1, wherein the latch has a projection and the shaft of the combination controlled lock unit has a recess engaged with the projection of the latch such that the latch can be driven by the shaft to move.

3. The padlock as claimed in claim 2, wherein the latch further has at least one notch adjacent to the projection; the block portion of the latch protrudes from a periphery wall of the notch toward the projection; the bottom end of the pivotable shackle has a pivot portion pivotally mounted in the notch of the latch and stoppable by the block portion.

4. The padlock as claimed in claim 3, wherein the latch has two said notches, between which the projection is located, and two said block portions, each of which protrudes from the periphery wall of the respective notch toward the projection; the bottom ends of the shackles each have said pivot portion.

5. The padlock as claimed in claim 1, further comprising a positioning member mounted with the latch and positioned in a first concavity of the base when the latch is located at the locking position and positioned in a second concavity of the base when the latch is located at the unlocking position.

6. The padlock as claimed in claim 5, wherein the positioning member includes an urging member and an elastic member respectively stopped against the urging member and the latch.

7. The padlock as claimed in claim 1, wherein the top end of the one of the shackles has a protrusion and the top end of the other one of the shackles has a hole for insertion of the protrusion.

8. The padlock as claimed in claim 1, wherein the base has at least one guide and the latch has at least one guide slot for insertion of the guide of the base such that the latch is movable relative to the base along the guide.

9. The padlock as claimed in claim 8, wherein the base has two said guides and the latch has two said guide slots.

* * * * *